US007479935B2

(12) United States Patent
Choi et al.

(10) Patent No.: US 7,479,935 B2
(45) Date of Patent: Jan. 20, 2009

(54) PLASMA DISPLAY APPARATUS AND METHOD OF DRIVING THE SAME

(75) Inventors: Jeong Pil Choi, Suwon-si (KR); Beong Ha Lim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 630 days.

(21) Appl. No.: 11/122,061

(22) Filed: May 5, 2005

(65) Prior Publication Data

US 2005/0264481 A1 Dec. 1, 2005

(30) Foreign Application Priority Data

May 6, 2004 (KR) ..... 10-2004-0031703

(51) Int. Cl.
*G09G 3/28* (2006.01)

(52) U.S. Cl. ..... 345/60; 345/66; 345/68

(58) Field of Classification Search ..... 345/55, 345/58, 60, 61, 62, 63, 68, 205, 206, 211, 345/212, 213; 315/167, 169.1, 169.4, 111.01, 315/111.21; 313/483, 484, 567, 581, 582, 313/584, 585, 604, 622
See application file for complete search history.

(56) References Cited

U.S. PATENT DOCUMENTS 5,670,974 A * 9/1997 Ohba et al. ..... 345/60
5,717,437 A * 2/1998 Sano et al. ..... 345/211
5,828,353 A * 10/1998 Kishi et al. ..... 345/55
6,111,556 A * 8/2000 Moon ..... 345/60
6,677,920 B2 * 1/2004 Huang et al. ..... 345/60

FOREIGN PATENT DOCUMENTS

JP 2000-172223 A 6/2000

* cited by examiner

*Primary Examiner*—My-Chau T Tran
(74) *Attorney, Agent, or Firm*—Birch, Stewart, Kolasch & Birch, LLP

(57) ABSTRACT

Disclosed is a plasma display apparatus and a method of driving the same. The plasma display apparatus and method of driving the same, in which a plasma display panel displays images by constituting a plurality of sub-fields including a reset period in one frame, are characterized in that: gray levels are controlled by applying a sustain voltage supplied during the sustain period of a specific one of the sub-fields at a different time than the sustain voltage supplied during the sustain period of the other sub-fields.

19 Claims, 11 Drawing Sheets

PLASMA DISPLAY APPARATUS AND METHOD OF DRIVING THE SAME

This nonprovisional application claims priority under 35 U.S.C. § 119(a) on Patent Application No. 2004-0031703 filed in Korea on May 6, 2004, the entire contents of which are hereby incorporated by reference.

BACKGROUND OF THE INVENTION

1. Field of the Invention

The present invention relates to a plasma display apparatus and method of driving the same, and more particularly to, a plasma display apparatus and method of driving the same, which can improve a gray-level expression.

2. Description of the Background Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture inclusive of characters or graphics. Such a PDP is easy to be made into a thin-film and large-dimension type. Moreover, the PDP provides a very improved picture quality owing to a recent technical development. Especially, a three electrode AC surface discharge type PDP has wall charges accumulated in its surface upon discharge and protects its electrodes from the sputtering generated by the discharge, thus it has an advantage of low voltage drive and long life span.

Referring to FIG. 1, a discharge cell of a conventional three-electrode, AC surface-discharge PDP includes a scan electrode Y and a sustain electrode Z provided on an upper substrate 10, and an address electrode X provided on a lower substrate 18. Each of the scan electrode Y and the sustain electrode Z includes transparent electrodes 12Y and 12Z, and metal bus electrodes 13Y and 13Z having smaller line widths than the transparent electrodes 12Y and 12Z and provided at one edge of the transparent electrodes 12Y and 12Z.

The transparent electrodes 12Y and 12Z are usually formed from indium-tin-oxide (ITO) on the upper substrate 10. The metal bus electrodes 13Y and 13Z are usually formed from a metal such as chrome (Cr), etc. on the transparent electrodes 12Y and 12Z to thereby reduce a voltage drop caused by the transparent electrodes 12Y and 12Z having a high resistance.

On the upper substrate 10 provided, in parallel, with the scan electrode 30Y and the common sustain electrode 30Z, an upper dielectric layer 14 and a protective film 16 are disposed. Wall charges generated upon plasma discharge are accumulated onto the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode X. The surfaces of the lower dielectric layer 22 and the barrier ribs 24 are coated with a phosphorous material 26. The address electrode X is formed in a direction crossing the scan electrode Y and the sustain electrode Z. The barrier rib 24 is formed in parallel to the address electrode X to thereby prevent an ultraviolet ray and a visible light generated by a discharge from being leaked to the adjacent discharge cells. The phosphorous material 26 is excited by an ultraviolet ray generated during the plasma discharge to generate any one of red, green and blue visible light rays. An inactive mixture gas is injected into a discharge space defined between the upper and lower substrate 10 and 18 and the barrier rib 24.

Such a PDP makes a time-divisional driving of one frame, which is divided into various sub-fields having a different emission frequency, so as to realize gray levels of a picture. Each sub-field is again divided into a reset period for initializing the entire field, an address period for selecting a scan line and selecting the cell from the selected scan line and a sustain period for expressing gray levels depending on the discharge frequency.

Herein, the reset period is again divided into a set-up interval supplied with a rising ramp waveform and a set-down interval supplied with a falling ramp waveform.

For instance, when it is intended to display a picture of 256 gray levels, a frame interval equal to {fraction (1/60)} second (i.e. 16.67 ms) is divided into 8 sub-fields SF1 to SF8 as shown in FIG. 2. Each of the 8 sub-field SF1 to SF8 is divided into a reset period, an address period and a sustain period as mentioned above. Herein, the reset period and the address period of each sub-field are equal for each sub-field, whereas the sustain period and the number of sustain pulses assigned thereto are increased at a ratio of 2n (wherein n=0, 1, 2, 3, 4, 5, 6 and 7) at each sub-field.

FIG. 3 shows a driving waveform of the PDP applied to two sub-fields.

Referring to FIG. 3, the PDP is divided into a reset period for initializing, the full fields, an address period for selecting a cell, and a sustain period for sustaining a discharge of the selected cell for its driving.

In the reset period, a rising ramp waveform Ramp-up is simultaneously applied to all the scan electrodes Y in a set-up interval. This rising ramp waveform Ramp-up causes a weak discharge within cells at the full field to generate wall charges within the cells. In the set-down internal, after the rising ramp waveform Ramp-up was supplied, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field.

In the address period, a negative scanning pulse scan is sequentially applied to the scan electrodes Y and, at the same time, a positive data pulse data is applied to the address electrodes X. A voltage difference between the scanning pulse scan and the data pulse data is added to a wall voltage generated in the reset period to thereby generate an address discharge within the cells supplied with the data pulse data. Wall charges are formed within the cells selected by the address discharge.

Meanwhile, a positive direct current voltage having a sustain voltage level Vs is applied to the sustain electrodes Z during the set-down interval and the address period.

In the sustain period, a sustain pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrodes Y and the sustain electrode Z whenever each sustain pulse sus is applied. Finally, after the sustain discharge was finished, an erasing ramp waveform erase having a small pulse width is applied to the sustain electrode Z to thereby erase wall charges left within the cells.

The thus-driven PDP expresses a gray level using a number of sustain pulses supplied during the sustain period. However, the expression of gray levels using the number of sustain pulses leads to a problem in that an expressible gray level is restricted. In more detail, the sustain pulses supplied during the sustain period generates a sustain discharge, and gray levels are expressed according to the number of sustain discharges. Here, the light generated by the sustain discharge is set to a constant amount, thereby being unable to express fine gray levels. For instance, in a conventional PDP, there was no method for display gray levels corresponding to half the light generated by a sustain discharge.

SUMMARY OF THE INVENTION

Accordingly, an object of the present invention is to solve at least the problems and disadvantages of the background art.

In order to achieve these and other objects of the invention, a plasma display apparatus and a method of driving the same according to one aspect of the present invention, in which a plasma display panel displays images by constituting a plurality of sub-fields including a reset period in one frame, are characterized in that: gray levels are controlled by applying a sustain voltage supplied during the sustain period of a specific one of the sub-fields at a different time than the sustain voltage supplied during the sustain period of the other sub-fields.

A plasma display apparatus and method of driving the same according to another aspect of the present invention, in which a plasma display panel displays images by constituting a plurality of sub-fields including a reset period in one frame, are characterized in that: when a sustain pulse is supplied to the plasma display panel during the sustain period by using an energy recovery equipment, gray levels are controlled by adjusting the turn-on timing of a switch connected to a sustain voltage source of the energy recovery equipment.

In the plasma display apparatus and method of driving the same, gray level expression can be improved by adjusting the intensity of light generated during the sustain period.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
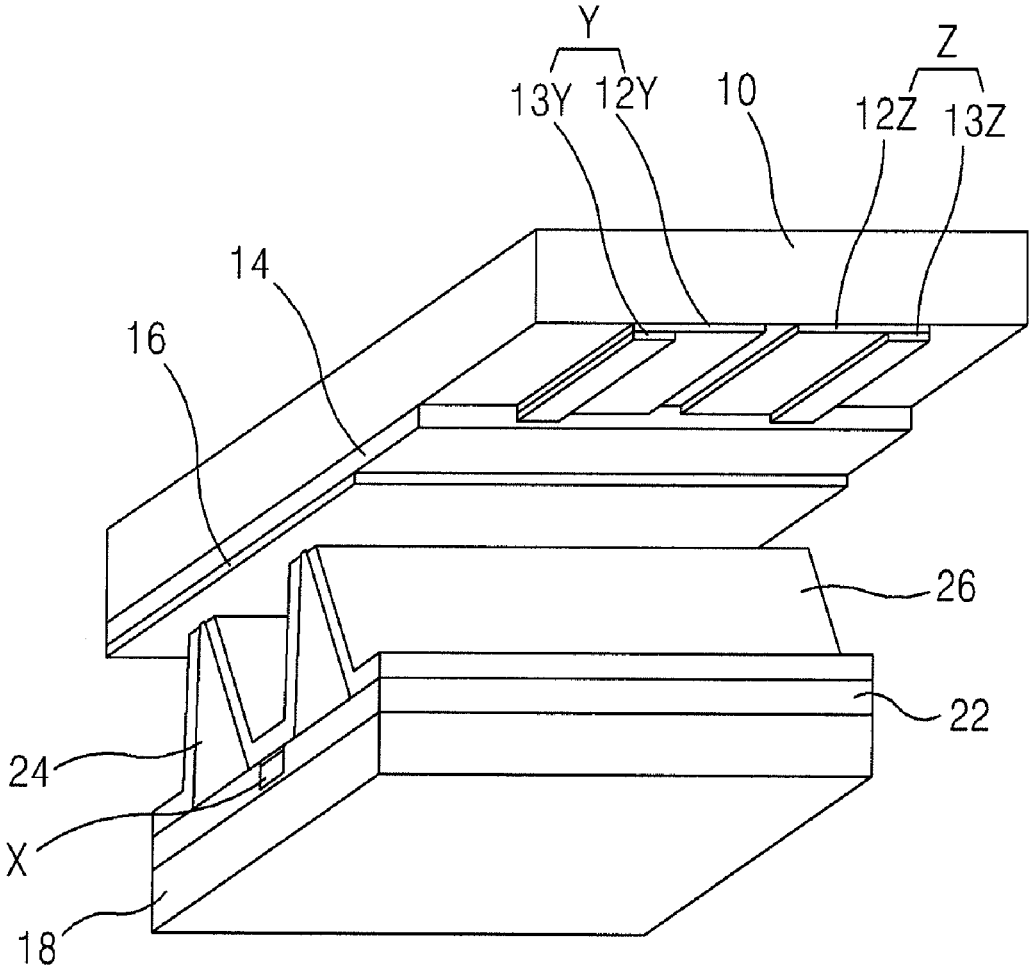
FIG. 1 CONVENTIONAL ART
FIG. 1 is a view schematically showing the arrangement of electrodes of a conventional three-electrode, AC surface-discharge plasma display panel.
Figure 2:
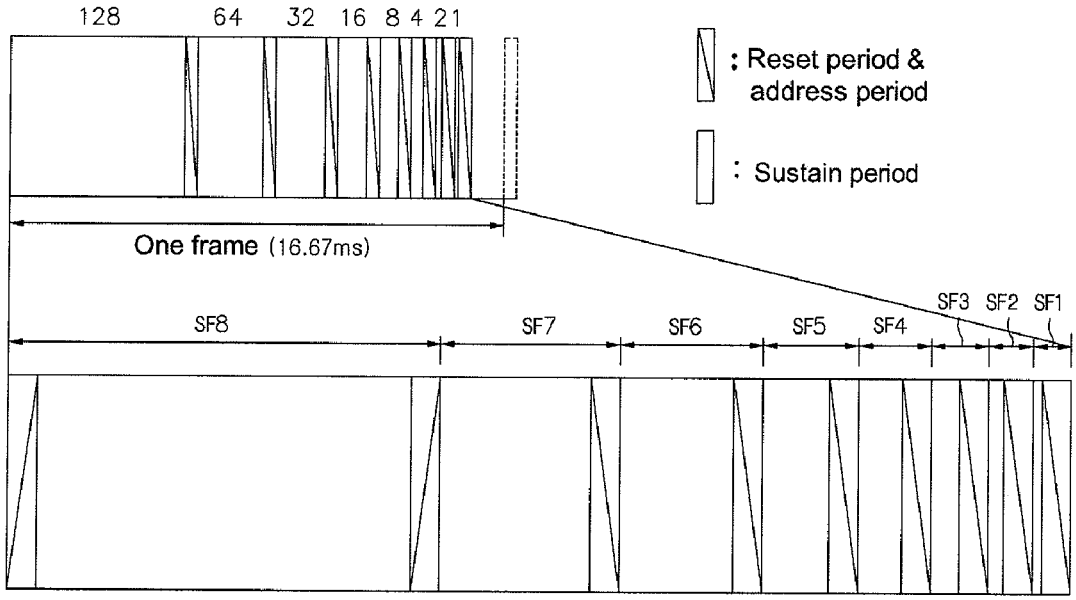
FIG. 2 CONVENTIONAL ART
FIG. 2 is a view showing one frame of a conventional plasma display panel.
Figure 3:
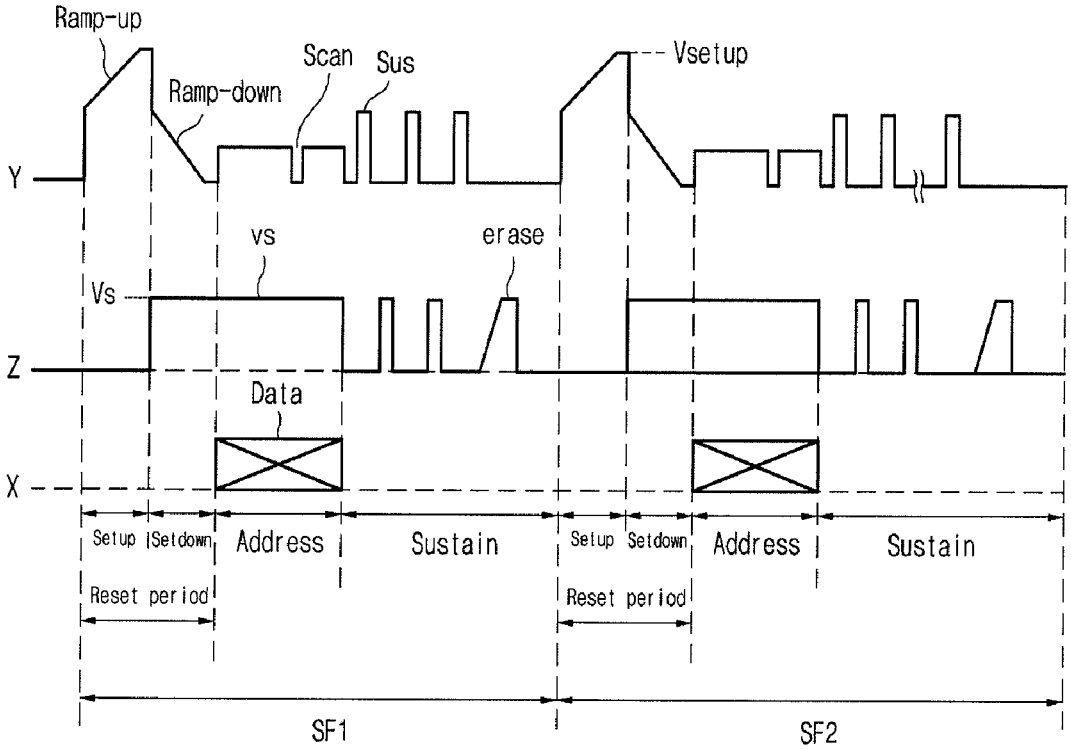
FIG. 3 CONVENTIONAL ART
FIG. 3 is a waveform diagram showing a method of driving a general plasma display panel.

Preferred embodiments of the present invention will be described in a more detailed manner with reference to the drawings.

The plasma display apparatus and method of driving the same according to one aspect of the present invention, in which a plasma display panel displays images by constituting a plurality of sub-fields including a reset period in one frame, are characterized in that: gray levels are controlled by applying a sustain voltage supplied during the sustain period of a specific one of the sub-fields at a different time than the sustain voltage supplied during the sustain period of the other sub-fields.

The sustain voltage is supplied from a sustain voltage source.

The gray levels displayed in the specific sub-field have a decimal value.

The plasma display apparatus and method of driving the same according to another aspect of the present invention, in which a plasma display panel displays images by constituting a plurality of sub-fields including a reset period in one frame, are characterized in that: when a sustain pulse is supplied to the plasma display panel during the sustain period by using an energy recovery equipment, gray levels are controlled by adjusting the turn-on timing of a switch connected to a sustain voltage source of the energy recovery equipment.

In the controlling of gray levels by adjusting the turn-on timing of the switch, the switch is turned on after a first time from the point of time when a voltage is supplied in a resonant waveform to a panel capacitor equivalently formed between a scan electrode and a sustain electrode so as to display gray levels equal to a preassigned brightness weight, the switch is turned on after a second time, which is different from the first time, from the point of time when a voltage is supplied in a resonant waveform to the panel capacitor so as to display gray levels higher than the preassigned brightness weight, and the switch is turned on after a third time, which is different from the first time, from the point of time when a voltage is supplied in a resonant waveform to the panel capacitor so as to display gray levels lower than the preassigned brightness weight.

The first time is set as a time approximately when the sustain voltage is charged to the panel capacitor.

The second time is set shorter than the first time.

The third time is set longer than the first time.

A sustain pulse generated when the switch is turned on after the second time is supplied during the sustain period of at least one of a plurality of sub-fields included in one frame.

A sustain pulse generated when the switch is turned on after the third time is supplied during the sustain period of at least one of a plurality of sub-fields included in one frame.

A sustain pulse generated when the switch is turned on after the third time is supplied during the sustain period of at least one of a plurality of sub-fields included in one frame.

A sustain pulse generated when the switch is turned on after the second time is supplied during the sustain period of at least one of a plurality of frames included in one second.

A sustain pulse generated when the switch is turned on after the third time is supplied during the sustain period of at least one of a plurality of frames included in one second.

A sustain pulse generated when the switch is turned on after the third time is supplied during the sustain period of at least one of a plurality of frames included in one second.

At least one sustain pulse generated when the switch is turned on after the second time is supplied during the sustain period.

At least one sustain pulse generated when the switch is turned on after the third time is supplied during the sustain period.

At least one sustain pulse generated when the switch is turned on after the third time is supplied during the sustain period.

Hereinafter, a preferred embodiment of the present invention will be described in detail with reference to the accompanying drawings.

Figure 4:
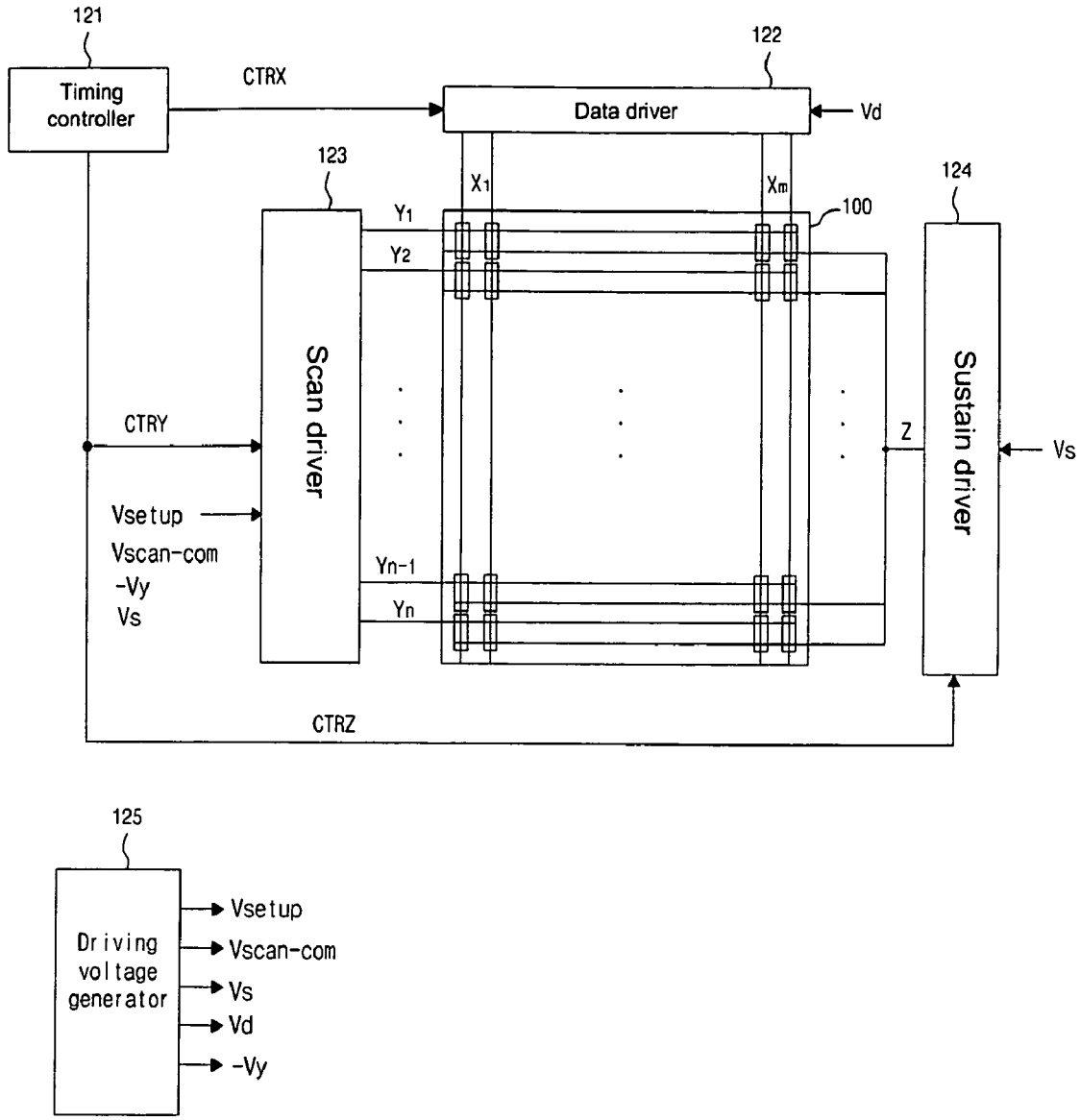
FIG. 4 is a view schematically showing a structure of a plasma display apparatus according to the present invention.

FIG. 4 is a view schematically showing a structure of a plasma display apparatus according to the present invention.

Referring to FIG. 4, the plasma display apparatus includes a plasma display panel 100, a data driver 122 for supplying data to address electrodes X1 to Xm formed on a lower substrate (not shown) of the plasma display panel 100, a scan driver 123 for driving scan electrodes Y1 to Yn, a sustain driver 124 for driving sustain electrodes Z, that is, common electrodes, a timing controller 121 for controlling the data driver 122, scan driver 123, sustain driver 124 and sustain pulse control unit 126 when the plasma display panel is driven; and a driving voltage generator for supplying a driving voltage required for each driver 122, 123 and 124.

The plasma display apparatus expresses an image formed of frames by combination of at least one sub-field in which a driving pulse is applied to address electrodes, scan electrodes and sustain electrodes during a reset period, an address period and a sustain period.

Here, in the plasmas display panel 100, an upper substrate (not shown) and a lower substrate (not shown) are attached at a predetermined interval, a multiplicity of electrodes, for example, a pair of scan electrodes Y1 to Yn and a pair of sustain electrodes Z, are formed on the upper substrate, and address electrodes X1 to Xm are formed on the lower substrate in a direction crossing the scan electrodes Y1 to Yn and the sustain electrodes Z.

The data driver 122 is supplied with data that is subject to an inverse-gamma correction and an error diffusion by an inverse-gamma correction circuit and an error diffusion circuit, and thereafter mapped onto each sub-field by a sub-field mapping circuit. The data driver 122 samples and latches a data in response to a timing control signal CTRX from the timing controller 121, and then supplies the data to the address electrodes X1 to Xm.

The scan driver 123 applies a rising ramp waveform Ramp-up to the scan electrodes Y1 to Yn during the reset period and then applies a falling ramp waveform Ramp-down during the reset period under control of the timing controller 121. Further, the scan driver 123 sequentially supplies a scanning pulse Sp having a scan voltage −Vy to the scan electrodes Y1 to Yn during the address period and then applies a sustain pulse sus to the scan electrodes Y1 to Yn during the sustain period under control of the timing controller 121.

The sustain driver 124 supplies a bias voltage of a sustain voltage Vs to the sustain electrodes Z during the falling Ramp-down period and the address period, and then is operated alternately with the scan driver 123 to apply a sustain pulse sus to the sustain electrodes Z during the sustain period under control of the timing controller.

Meanwhile, the scan driver 123 and the sustain driver 124 supplying a sustain pulse to the scan electrodes and the sustain electrodes during the sustain period of the plurality of sub-fields control gray levels depending on the intensity of light generated during the sustain period by applying a sustain voltage supplied during the sustain period of a specific one of the sub-fields at a different time than the sustain voltage supplied during the sustain period of the other sub-fields. At this point, the gray levels depending on the intensity of light generated during the sustain period of a specific sub-field have a decimal value, and the sustain voltage is a voltage supplied to a plasma display panel capacitor from a sustain voltage source when a second switch in energy recovery equipment of FIG. 5 to be explained later is turned on.

The timing controller 121 receives vertical/horizontal synchronizing signals and a clock signal to generate timing control signals CTRX, CTRY and CTRZ required for the operation timing and synchronization of each driver 122, 123 and 124 during the reset period, address period and sustain period, and supplies the timing control signals CTRX, CTRY and CTRZ to the corresponding drivers 122, 123 and 124, thereby controlling each driver 122, 123 and 124.

The data control signal CTRX includes a sampling clock for sampling a data, a latch control signal and a switching control signal for controlling an ON/OFF time of an energy recovery circuit and a driving switching device. The scan control signal CTRY includes a switching control signal for controlling an ON/OFF time of the energy recovery circuit and the driving switching device within the scan driver 123. The sustain control signal CTRZ includes a switching control signal for controlling an ON/OFF time of the energy recovery circuit and the driving switching device within the sustain driver 124.

The driving voltage generator 125 generates a setup voltage Vsetup, a scan common Vscan-com, a scan voltage −Vy, a sustain voltage Vs and a data voltage, etc. Such driving voltages may be changed depending upon a component of discharge gas or a structure of discharge cell.

Figure 5:
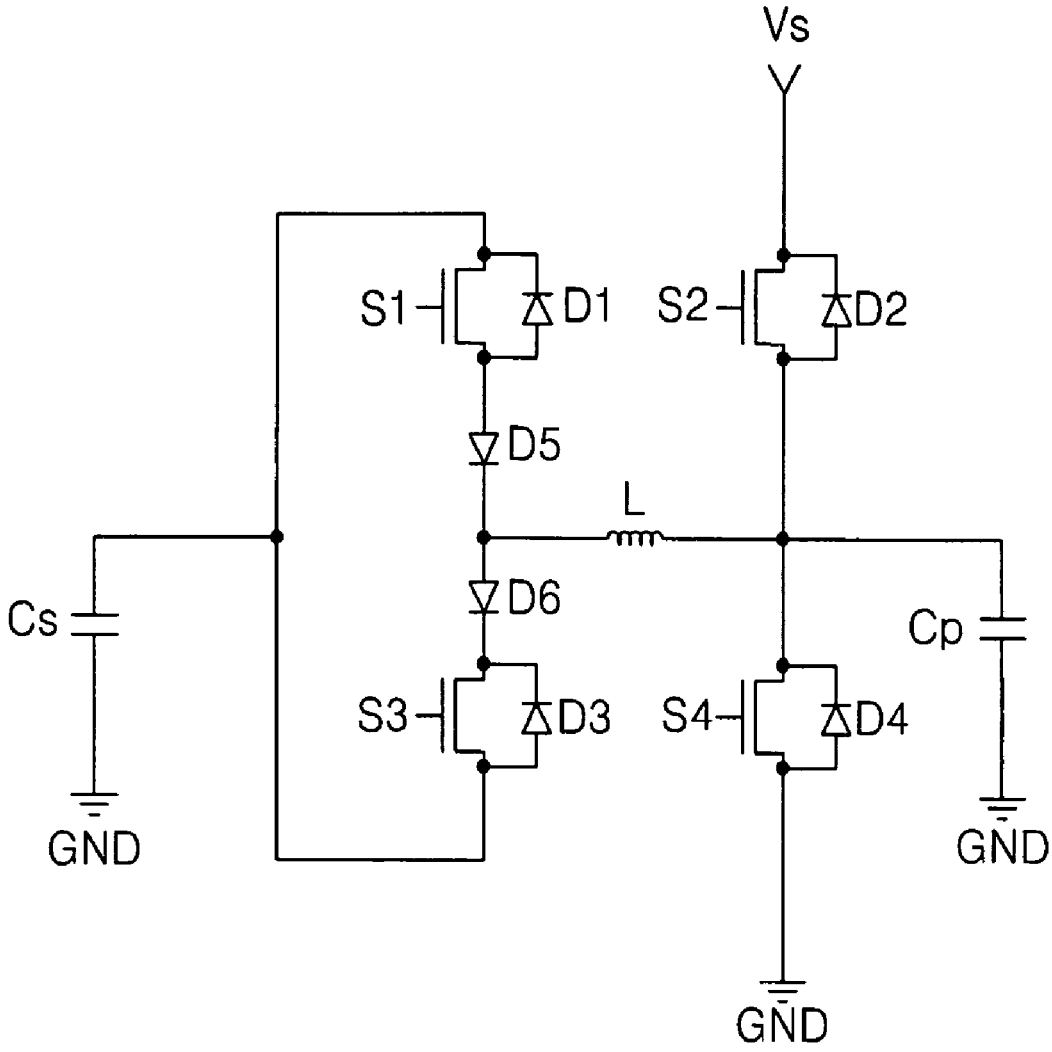
FIG. 5 is a view showing energy recovery equipment included in the plasma display apparatus according to the present invention.

FIG. 5 is a view showing energy recovery equipment included in the plasma display apparatus according to the present invention. The energy recovery equipment recovers a voltage between the scan electrode Y and the sustain electrode Z and uses the recovered voltage as a driving voltage during the next discharge.

Referring to FIG. 5, the first energy recovery equipment includes an inductor L connected between the panel capacitor Cp and a source capacitor Cs, first and third switches S1 and S3 connected in parallel between the source capacitor Cs and the inductor L, second and fourth switches S2 and S4 connected in parallel between the panel capacitor Cp and the inductor L, and fifth and sixth diodes D5 and D6 connected respectively between the switch S1 and the inductor L and between the third switch S3 and the inductor L.

The panel capacitor Cp equivalently denotes electrostatic capacitance formed between the scan electrode Y and the sustain electrode Z. The second switch S2 is connected to a sustain voltage (Vs) source, and the fourth switch S4 is connected to a ground voltage (GND) source. The source capacitor Cs charges its voltage by recovering a voltage charged at the panel capacitor Cp during the sustain discharge and re-supplies the charged voltage to the panel capacitor Cp.

A voltage of VS/2 volts corresponding to half the sustain voltage Vs is charged at the source capacitor Cs. The inductor L and the panel capacitor Cp constitute a resonant circuit. The first to fourth switches S1 to S4 control the flow of current. The fifth and sixth diodes D5 and D6 serve to prevent reverse current. Internal diodes D1 to D4 are installed respectively at the interior of the first and fourth switches S1 to S4 to prevent reverse current.

Figure 6A:
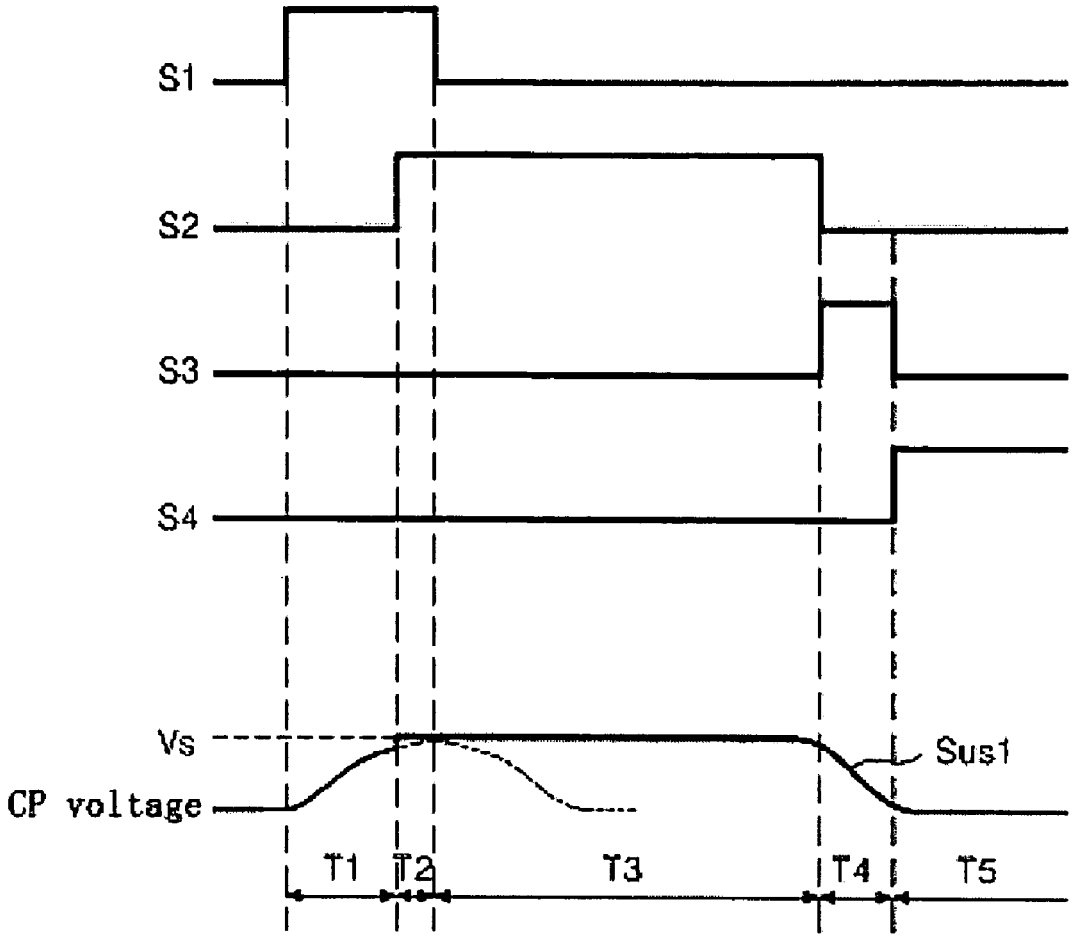
FIGS. 6*a* to 6*c* show timing diagrams and waveform diagrams of the energy recovery equipment of the present invention.
Figure 6B:
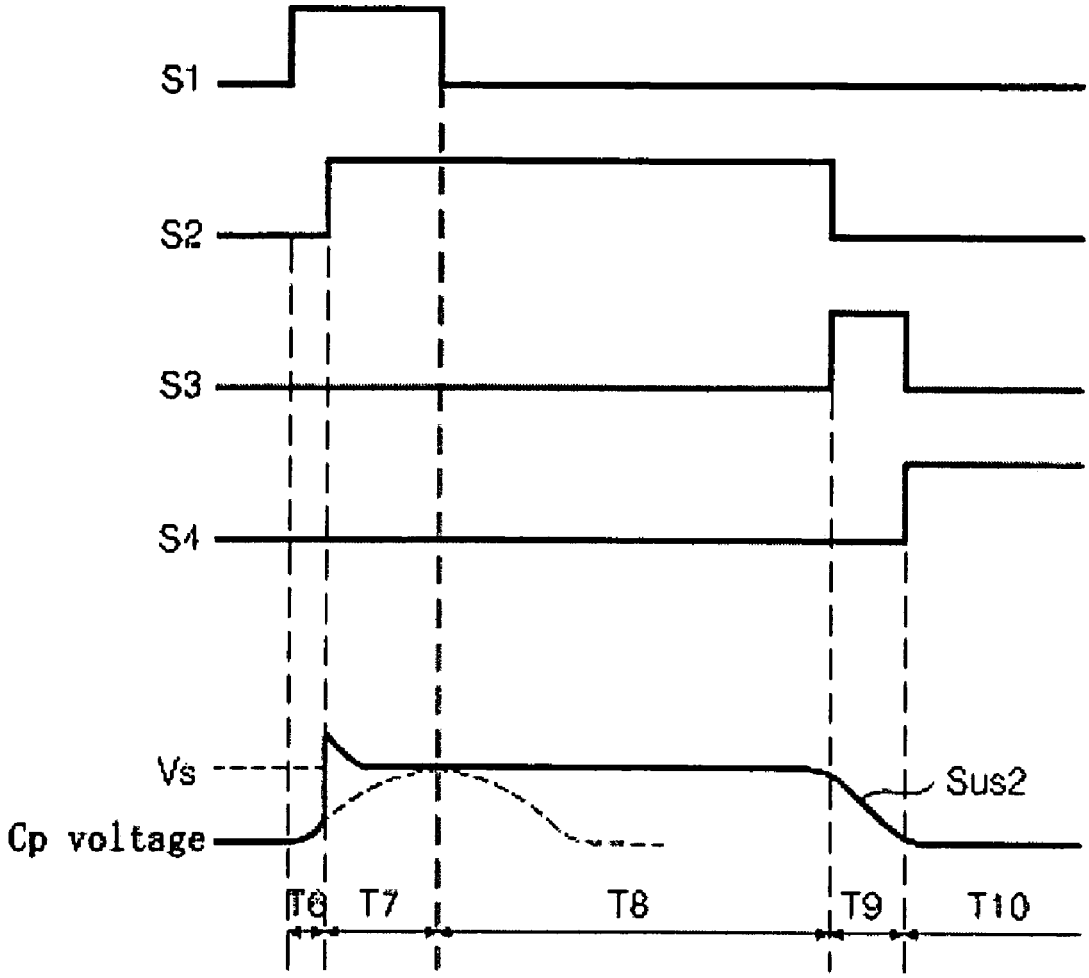
Figure 6C:
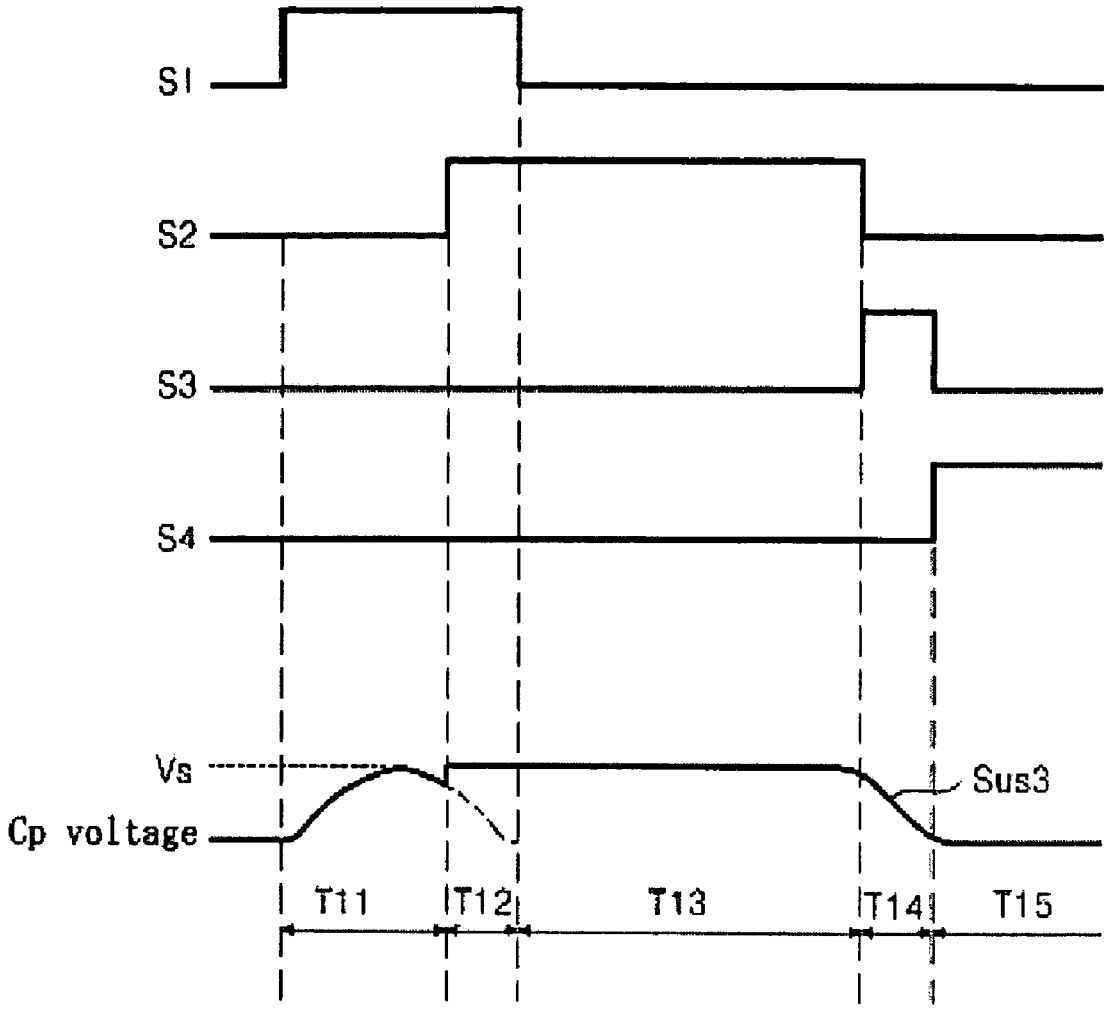

The above-described energy recovery equipment of this invention is driven by the timing as shown in FIGS. 6*a* to 6*c*.

FIG. 6*a* shows a timing diagram and a waveform diagram generally used in the energy recovery equipment of the present invention.

An operation of the energy recovery equipment will now be described in detail under the assumption that a voltage of 0 volts is charged at the panel capacitor Cp and a voltage of VS/2 volts is charged at source capacitor Cs before a period T1.

During a period T1, the first switch S1 is turned ON and a current path is formed through the source capacitor Cs, the fist switch S1, tire inductor L and the panel capacitor Cp. If the current path is formed, a voltage of VS/2 volts charged at the source capacitor Cs is supplied to the panel capacitor Cp. In this case, since the inductor L and the panel capacitor Cp constitute a serial resonant circuit, a voltage raised up in a resonant waveform is charged at the panel capacitor Cp.

During a period T2, the second switch S2 is turned ON. Then a voltage of the sustain voltage Vs source is supplied to the panel capacitor Cp. The voltage of the sustain voltage Vs source supplied to the panel capacitor Cp prevents the panel capacitor Cp from being lowered below the sustain voltage Vs, thereby stably generating a sustain discharge. Here, the second switch S2 is turned ON approximately when the sustain voltage Vs is charged at the panel capacitor Cp. Then the voltage supplied to the panel capacitor Cp is minimized to reduce power consumption.

During a period T3, the first switch S1 is turned OFF. During this period T3, the panel capacitor Cp maintains the sustain voltage Vs.

During a period T4, the second switch S2 is turned OFF and the third switch S3 is turned ON. If the third switch S3 is turned ON, a current path is formed through the panel capacitor Cp, the inductor L, the third switch S3 and the source capacitor Cs, and a voltage charged at the panel capacitor Cp is recovered to the source capacitor Cs. Then a voltage of VS/2 is charged at the source capacitor Cs.

During a period T5, the third switch S3 is turned OFF and the fourth switch S4 is turned ON. If the fourth switch S4 is turned ON, a current path is formed through the panel capacitor Cp and the ground voltage GND, and a voltage of the panel capacitor Cp is lowered to 0 volts. A sustain pulse supplied to the scan electrode Y and sustain electrode Z is obtained by periodically repeating the periods T1 to T5. Hereinafter, a sustain pulse supplied by the timing of FIG. 6*a* is referred to as a first sustain pulse sus1 for the convenience of explanation.

FIG. 6*b* shows a timing diagram and a waveform diagram used for expressing high gray levels in the energy recovery equipment of the present invention.

An operation of the energy recovery equipment will now be described in detail under the assumption that a voltage of 0 volts is charged at the panel capacitor Cp and a voltage of VS/2 volts is charged at source capacitor Cs before a period T6.

During a period T6, the first switch S1 is turned ON and a current path is formed through the source capacitor Cs, the fist switch S1, tire inductor L and the panel capacitor Cp. If the current path is formed, a voltage of VS/2 volts charged at the source capacitor Cs is supplied to the panel capacitor Cp. In this case, since the inductor L and the panel capacitor Cp constitute a serial resonant circuit, a voltage raised up in a resonant waveform is charged at the panel capacitor Cp.

During a period T7, the second switch S2 is turned ON after a predetermined voltage is charged at the panel capacitor Cp during the period T6. When the second switch S2 is turned ON, a voltage of the sustain voltage Vs source is supplied to the panel capacitor Cp. When the voltage of the sustain voltage Vs source is supplied to the panel capacitor Cp, a voltage of the panel capacitor Cp is raised up to the sustain voltage Vs, thereby stably generating a sustain discharge. Here, the turn-on timing of the second switch S2 as shown in FIG. 6*b* is set differently from the turn-on timing of the second switch S2 as shown in FIG. 6*b*.

More specifically, in FIG. 6*a*, the turn-on timing of the second switch S2 is determined as a time when a voltage of Vs is charged at the panel capacitor Cp. In other words, in FIG. 6*a*, the second switch S2 is turned ON after a first time T1 when a voltage of Vs can be charged at the panel capacitor Cp from the point of time when a voltage is charged at the panel capacitor Cp. In FIG. 6*b*, the turn-on timing of the second switch S2 is turned ON after a second time T6 from the point of time when a voltage is charged at the panel capacitor Cp. Here, since the second time T6 is set shorter than the first time T1, the second switch S2 is turned ON at the point of time when a low voltage (for example, a voltage less than ⅔ Vs) is charged at the panel capacitor Cp in FIG. 6*b*.

If the second switch S2 is turned ON after the second time T6 from the point of time when a voltage is charged at the panel capacitor Cp (that is, when the second switch S2 is turned ON at the point of time when a low voltage is charged at the panel capacitor Cp), a sustain discharge stronger than a first sustain pulse sus1 is experimentally generated. Practically, if the second switch S2 is turned ON at the point of time (rising period) when a low voltage is charged at the panel capacitor Cp, a voltage of the panel capacitor Cp is sharply raised up. Thus the voltage of the panel capacitor Cp is raised up to more than the sustain voltage Vs and then is lowered to the sustain voltage Vs. In this case, a strong sustain discharge occurs within a discharge cell. In this invention, fine gray levels that are impossible to express by a conventional method can be displayed by using a driving waveform as shown in FIG. 6*b*.

During a period T8, the first switch S1 is turned OFF. During this period T8, the panel capacitor Cp maintains the sustain voltage Vs.

During a period T9, the second switch S2 is turned OFF and the third switch S3 is turned ON. If the third switch S3 is turned ON, a current path is formed through the panel capacitor Cp, the inductor L, the third switch S3 and the source capacitor Cs, and a voltage charged at the panel capacitor Cp is recovered to the source capacitor Cs. Then a voltage of VS/2 is charged at the source capacitor Cs.

During a period T10, the third switch S3 is turned OFF and the fourth switch S4 is turned ON. If the fourth switch S4 is turned ON, a current path is formed through the panel capacitor Cp and the ground voltage GND, and a voltage of the panel capacitor Cp is lowered to 0 volts. A sustain pulse supplied to the scan electrode Y and sustain electrode Z is obtained by periodically repeating the periods T6 to T10. Hereinafter, a sustain pulse supplied by the timing of FIG. 6*b* is referred to as a second sustain pulse sus2 for the convenience of explanation.

FIG. 6*c* shows a timing diagram and a waveform diagram used for expressing low gray levels in the energy recovery equipment of the present invention.

An operation of the energy recovery equipment will now be described in detail under the assumption that a voltage of 0 volts is charged at the panel capacitor Cp and a voltage of VS/2 volts is charged at source capacitor Cs before a period T11.

During a period T11, the first switch S1 is turned ON and a current path is formed through the source capacitor Cs, the fist switch S1, tire inductor L and the panel capacitor Cp. If the current path is formed, a voltage of VS/2 volts charged at the source capacitor Cs is supplied to the panel capacitor Cp. In this case, since the inductor L and the panel capacitor Cp constitute a serial resonant circuit, a voltage raised up in a resonant waveform is charged at the panel capacitor Cp.

During a period T12, the second switch S2 is turned ON after a predetermined voltage is charged at the panel capacitor Cp during the period 11. When the second switch S2 is turned ON, a voltage of the sustain voltage Vs source is supplied to the panel capacitor Cp. When the voltage of the sustain voltage Vs source is supplied to the panel capacitor Cp, a voltage of the panel capacitor Cp is raised up to the sustain voltage Vs, thereby stably generating a sustain discharge. Here, the turn-on timing of the second switch S2 as shown in FIG. 6*c* is set differently from the turn-on timing of the second switch S2 as shown in FIGS. 6*a* and 6*b*.

More specifically, the turn-on timing of the second switch S2 as shown in FIG. 6*c* is set as a third time T11 which is longer than the first time T1. Here, if the second switch S2 is turned ON after the third time T11 from the point of time when a voltage is charged at the panel capacitor Cp, the voltage of the panel capacitor Cp is lowered in a resonant waveform and then is raised up to a sustain voltage Vs.

As above, if the second switch S2 is turned ON after the third time T11 from the point of time when a voltage is charged at the panel capacitor Cp, a sustain discharge weaker than a first sustain pulse sus1 is experimentally generated. Practically, if the second switch S2 is turned ON at the point of time when a voltage of the panel capacitor Cp is lowered in a resonant waveform a strong sustain discharge occurs within a discharge cell. In this invention, fine gray levels that are impossible to express by a conventional method can be displayed by using a driving waveform as shown in FIG. 6*c*.

During a period T13, the first switch S1 is turned OFF. During this period T8, the panel capacitor Cp maintains the sustain voltage Vs.

During a period T14, the second switch S2 is turned OFF and the third switch S3 is turned ON. If the third switch S3 is turned ON, a current path is formed through the panel capacitor Cp, the inductor L, the third switch S3 and the source capacitor Cs, and a voltage charged at the panel capacitor Cp is recovered to the source capacitor Cs. Then a voltage of VS/2 is charged at the source capacitor Cs.

During a period T15, the third switch S3 is turned OFF and the fourth switch S4 is turned ON. If the fourth switch S4 is turned ON, a current path is formed through the panel capacitor Cp and the ground voltage GND, and a voltage of the panel capacitor Cp is lowered to 0 volts. A sustain pulse supplied to the scan electrode Y and sustain electrode Z is obtained by periodically repeating the periods T11 to T15.

Hereinafter, a sustain pulse supplied by the timing of FIG. 6*c* is referred to as a third sustain pulse sus3 for the convenience of explanation.

As stated in foregoing description, the present invention has an advantage of adjusting the intensity of a sustain discharge by adjusting the turn-on timing of the second switch S2, and accordingly displaying fine gray levels. Practically, the first sustain pulse sus 1 to the third sustain pulse sus3 may be applicable to gray level expression in various applications by those skilled in the art.

Figure 7:
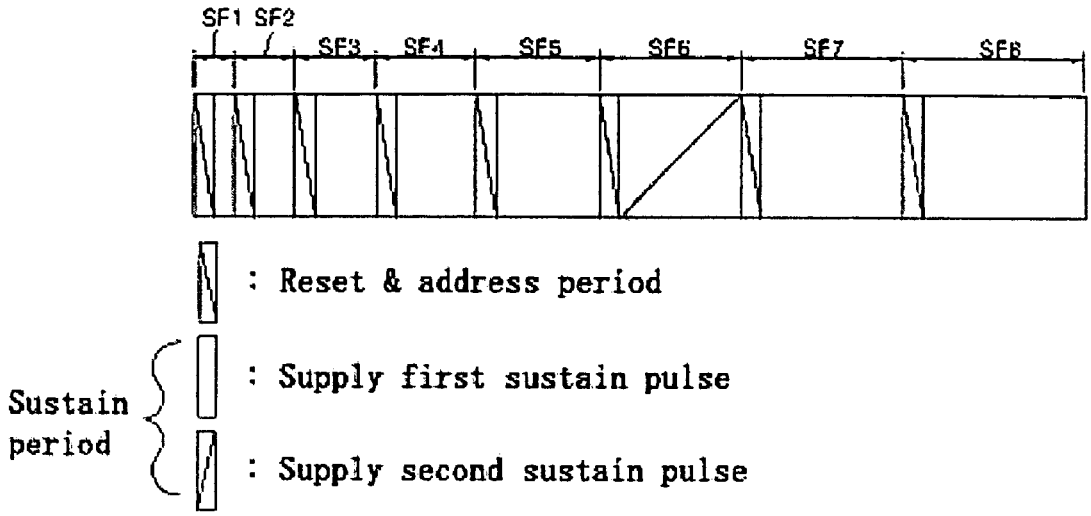
FIG. 7 is a view showing a first gray level expression method using the plasma display apparatus of the present invention.

FIG. 7 is a view showing a first gray level expression method using the plasma display apparatus of the present invention. In FIG. 7, gray level expression is improved by supplying a sustain pulse during at least one of the sustain periods of a plurality of sub-fields included in one frame, the sustain pulse being different than the ones supplied during the sustain period of the other sub-fields.

Referring to FIG. 7, in the first gray level expression method using the plasma display apparatus of this invention, a second sustain pulse sus2 is supplied during the sustain period of a sixth sub-field SF6, and a first sustain pulse sus1 is supplied during the sustain period of the other sub-fields. As above, if the second sustain pulse sus2 is supplied during the sustain period of the sixth sub-field SF6, gray levels higher than a preassigned brightness weight can be expressed.

The gray levels assigned to the sub-fields SF1 to SF8 of one frame are determined under the assumption that the first sustain pulse sus1 is supplied during the sustain period. For instance, the brightness weight of the sixth sub-field SF6 can be set to "32" under the assumption that the first sustain pulse sus1 is supplied. Here, if the second sustain pulse sus2 is supplied during the sustain period of the sixth sub-field SF6, gray levels higher than a preassigned brightness weight, for example, "33.5", can be expressed. That is, the first gray level expression method using the plasma display apparatus of this invention can improve gray level expression by supplying the second sustain pulse sus2 during the sustain period of at least one of the plurality of sub-fields included in one frame.

Figure 8:
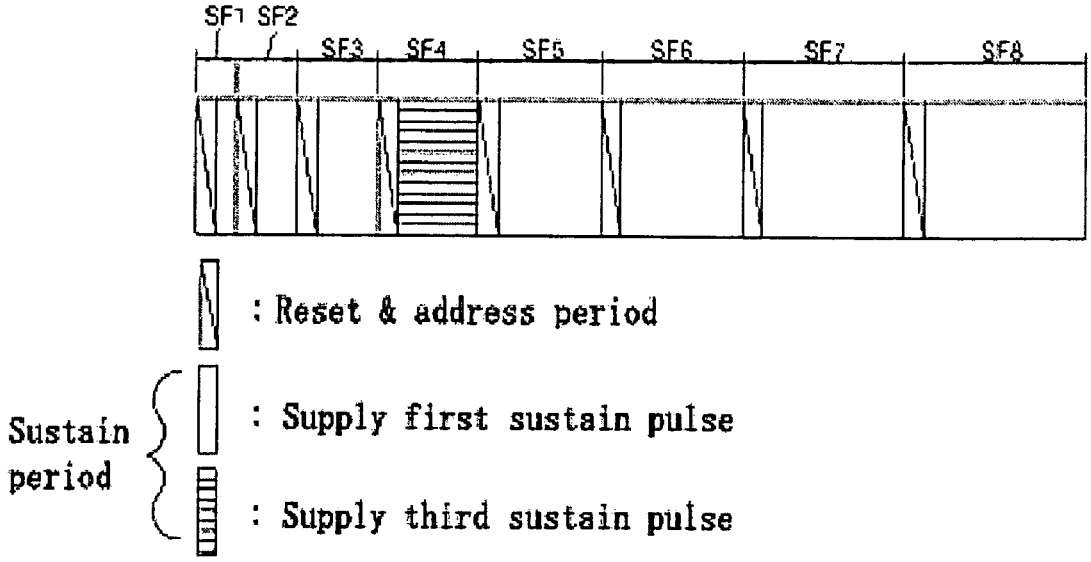
FIG. 8 is a view showing a second gray level expression method using the plasma display apparatus of the present invention.

FIG. 8 is a view showing a second gray level expression method using the plasma display apparatus of the present invention. In FIG. 8, gray level expression is improved by supplying a sustain pulse during at least one of the sustain periods of a plurality of sub-fields included in one frame, the sustain pulse being different than the ones supplied during the sustain period of the other sub-fields.

Referring to FIG. 8, in the second gray level expression method using the plasma display apparatus of this invention, a third sustain pulse sus3 is supplied during the sustain period of a fourth sub-field SF4, and a first sustain pulse sus1 is supplied during the sustain period of the other sub-fields. As above, if the third sustain pulse sus3 is supplied during the sustain period of the fourth sub-field SF4, gray levels lower than a preassigned brightness weight can be expressed.

The gray levels assigned to the sub-fields SF1 to SF8 of one frame are determined under the assumption that the first sustain pulse sus1 is supplied during the sustain period. For instance, the brightness weight of the fourth sub-field SF4 can be set to "8" under the assumption that the first sustain pulse sus1 is supplied. Here, if the third sustain pulse sus3 is supplied during the sustain period of the fourth sub-field SF4, gray levels higher than a preassigned brightness weight, for example, "7.5", can be expressed. That is, the first gray level expression method using the plasma display apparatus of this invention can improve gray level expression by supplying the third sustain pulse sus3 during the sustain period of at least one of the plurality of sub-fields included in one frame.

Figure 9:
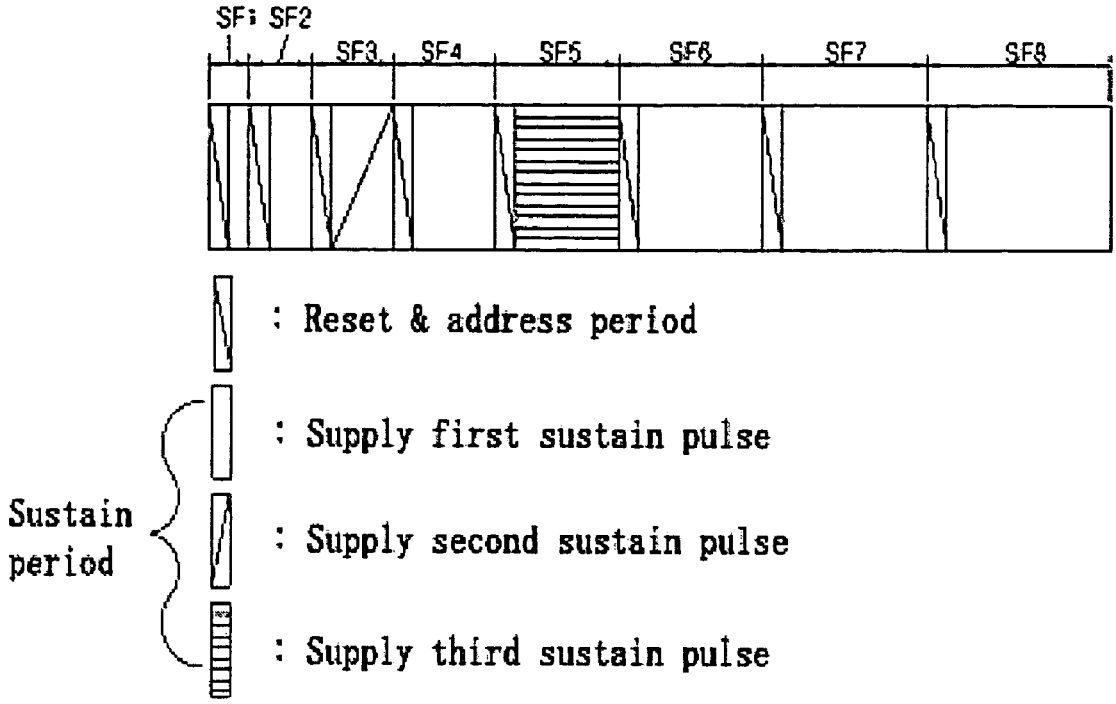
FIG. 9 is a view showing a third gray level expression method using the plasma display apparatus of the present invention.

FIG. 9 is a view showing a third gray level expression method using the plasma display apparatus of the present invention.

Referring to FIG. 9, in the third gray level expression method using the plasma display apparatus of this invention, a second sustain pulse sus2 is supplied during the sustain period of a third sub-field SF3, and a third sustain pulse su3 is supplied during the sustain period of a fifth sub-field SF5. As above, if the third sustain pulse sus3 is supplied during the sustain period of the fourth sub-field SF4, gray levels lower than a preassigned brightness weight can be expressed. A first sustain pulse sus1 is supplied during the sustain period of the other sub-fields except the third sub-field SF3 and the fifth sub-field SF5.

As above, gray levels different than a preassigned brightness weight can be displayed by supplying the second sustain pulse sus2, capable of expressing gray levels higher than the first sustain pulse sus1, and the third sustain pulse sus3, capable of expressing gray levels lower than the first sustain pulse sus1, to specific sub-fields SF3 and SF5, thereby improving gray level expression.

Figure 10A:
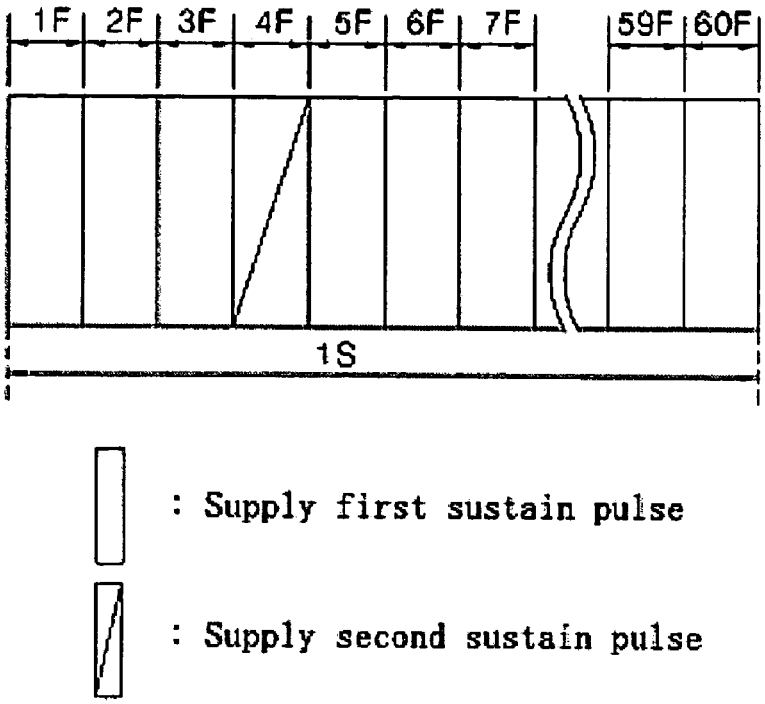
FIGS. 10*a* and 10*b* are views showing a fourth gray level expression method using the plasma display apparatus of the present invention.
Figure 10B:
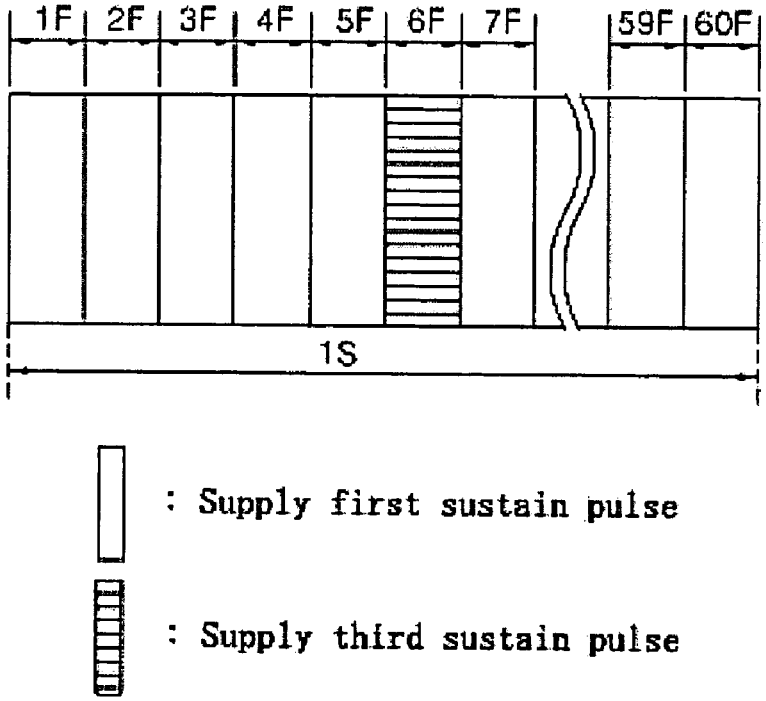

FIGS. 10*a* and 10*b* are views showing a fourth gray level expression method using the plasma display apparatus of the present invention.

Referring to FIGS. 10*a* and 10*b*, in the fourth gray level expression method using the plasma display apparatus of this invention, a second sustain pulse sus2 and/or a third sustain pulse sus3 are supplied during the sustain period of at least one of a plurality of frames (for example, 60F) included in one second is.

For instance, in FIG. 10*a*, a second sustain pulse is supplied during the sustain period of sub-fields included in a fourth frame 4F among 60 frames 60F included in one second, and a first sustain pulse is supplied during the sustain period of the sub-fields included in the other frames. In FIG. 10*b*, a third sustain pulse is supplied during the sustain period of sub-fields included in a sixth frame 6F among 60 frames 60F included in one second, and a first sustain pulse is supplied during the sustain period of the sub-fields included in the other frames.

As above, gray level expression can be improved by supplying the second sustain pulse sus2 or the third sustain pulse sus3 during the sustain period of the sub-fields included in at least one of the plurality of frames included in one second. Moreover, in this invention, gray level expression can be improved by supplying the second sustain pulse sus2 or the third sustain pulse sus3 during the sustain period of the sub-fields included in at least two of the plurality of frames included in one second.

Meanwhile, in the present invention, the first to third sustain pulses sus1 to sus3 can be supplied by various methods. For example, fine gray levels can be expressed by supplying at least one second and/or third sustain pulse sus2 and sus3 during the sustain period of each sub-field.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, in which each of a plurality of sub-fields is divided into a reset period, an address period and a sustain period to display an image of one frame, is characterized in that:

gray levels are controlled by applying a sustain voltage supplied during the sustain period of a specific one of the sub-fields at a different time than the sustain voltage supplied during the sustain period of the other sub-fields.

2. The apparatus of claim 1, wherein the sustain voltage is supplied from a sustain voltage source.

3. The apparatus of claim 1, wherein the gray levels displayed in the specific sub-field have a decimal value.

4. A plasma display apparatus, in which each of a plurality of sub-fields is divided into a reset period, an address period and a sustain period to express images of one frame, is characterized in that:

when a sustain pulse is supplied to a plasma display panel during the sustain period by using an energy recovery equipment, gray levels are controlled by controlling a time difference between a turn-on timing of a first switch connected to a source capacitor and a turn-on timing of a second switch connected to a sustain voltage source of the energy recovery equipment.

5. The apparatus of claim 4, wherein, in the controlling of gray levels by controlling a time difference between a turn-on timing of a first switch connected to a source capacitor and the turn-on timing of the second switch, the second switch is turned on after a first time from the point of time when a voltage is supplied in a resonant waveform to a panel capacitor equivalently formed between a scan electrode and a sustain electrode so as to display gray levels equal to a preassigned brightness weight, the second switch is turned on after a second time, which is different from the first time, from the point of time when a voltage is supplied in a resonant waveform to the panel capacitor so as to display gray levels higher than the preassigned brightness weight, and the second switch is turned on after a third time, which is different from the first time, from the point of time when a voltage is supplied in a resonant waveform to the panel capacitor so as to display gray levels lower than the preassigned brightness weight.

6. The apparatus of claim 5, wherein the first time is set as a time approximately when the sustain voltage is charged to the panel capacitor.

7. The apparatus of claim 5, wherein the second time is set shorter than the first time.

8. The apparatus of claim 5, wherein the third time is set longer than the first time.

9. The apparatus of claim 5, wherein a sustain pulse generated when the second switch is turned on after the second time is supplied during the sustain period of at least one of a plurality of sub-fields included in one frame.

10. The apparatus of claim 5, wherein a sustain pulse generated when the second switch is turned on after the third time is supplied during the sustain period of at least one of a plurality of sub-fields included in one frame.

11. The apparatus of claim 9, wherein a sustain pulse generated when the second switch is turned on after the third time is supplied during the sustain period of at least one of a plurality of sub-fields included in one frame.

12. The apparatus of claim 5, wherein a sustain pulse generated when the second switch is turned on after the second time is supplied during the sustain period of at least one of a plurality of frames included in one second.

13. The apparatus of claim 5, wherein a sustain pulse generated when the second switch is turned on after the third time is supplied during the sustain period of at least one of a plurality of frames included in one second.

14. The apparatus of claim 12, wherein a sustain pulse generated when the second switch is turned on after the third time is supplied during the sustain period of at least one of a plurality of frames included in one second.

15. The apparatus of claim 5, wherein at least one sustain pulse generated when the second switch is turned on after the second time is supplied during the sustain period.

16. The apparatus of claim 5, wherein at least one sustain pulse generated when the second switch is turned on after the third time is supplied during the sustain period.

17. The apparatus of claim 15, wherein at least one sustain pulse generated when the second switch is turned on after the third time is supplied during the sustain period.

18. A method of driving a plasma display apparatus, in which each of a plurality of sub-fields is divided into a reset period, an address period and a sustain period to express images of one frame, is characterized in that:

gray levels are controlled by applying a sustain voltage supplied during the sustain period of a specific one of the sub-fields at a different time than the sustain voltage supplied during the sustain period of the other sub-fields.

19. A method of driving a plasma display apparatus, in which each of a plurality of sub-fields is divided into a reset period, an address period and a sustain period to express images of one frame, is characterized in that:

when a sustain pulse is supplied to a plasma display panel during the sustain period by using an energy recovery equipment, gray levels are controlled by controlling a time difference between a turn-on timing of a first switch connected to a source capacitor and a turn-on timing of a second switch connected to a sustain voltage source of the energy recovery equipment.

* * * * *